United States Patent [19]

Mitsuya et al.

[11] 4,278,259

[45] Jul. 14, 1981

[54] DEVICE FOR SEALING SPINNING ROTOR IN AN OPEN-END SPINNING APPARATUS

[75] Inventors: Kinpei Mitsuya, Aichi; Noriaki Miyamoto; Masao Shiraki, both of Kariya, all of Japan

[73] Assignee: Kabushiki Kaisha Toyoda Jidoshokki Seisakusho, Kariya, Japan

[21] Appl. No.: 91,689

[22] Filed: Nov. 5, 1979

[30] Foreign Application Priority Data

Nov. 6, 1978 [JP] Japan ..... 53-152609[U]

[51] Int. Cl.[3] ..... D01H 1/12; F16J 15/16

[52] U.S. Cl. ..... 277/12; 277/134; 277/205; 277/212 C; 277/212 F; 57/58.89; 57/58.95

[58] Field of Search ..... 57/58.89, 58.95; 277/12, 31, 33, 188 R, 53, 205, 212 R, 212 C, 212 F, 133, 134

[56] References Cited

U.S. PATENT DOCUMENTS

| | | | |
|---|---|---|---|
| 3,028,181 | 4/1962 | Thompson et al. | 277/12 |
| 3,698,175 | 10/1972 | Dykast | 57/58.89 |
| 3,874,751 | 4/1975 | Okubo et al. | 57/58.89 X |
| 3,922,839 | 12/1975 | Sakurai et al. | 57/58.95 |
| 3,975,894 | 8/1976 | Suzuki | 57/58.89 |
| 4,030,279 | 3/1977 | Rambousek et al. | 57/58.89 |

FOREIGN PATENT DOCUMENTS

| | | | |
|---|---|---|---|
| 616520 | 3/1961 | Canada | 277/33 |
| 1490164 | 6/1967 | France | 57/58.89 |
| 702105 | 1/1954 | United Kingdom | 277/12 |

*Primary Examiner*—Robert S. Ward, Jr.

*Attorney, Agent, or Firm*—Sughrue, Rothwell, Mion, Zinn and Macpeak

[57] ABSTRACT

This invention provides a rotor sealing device used on an open-end spinning apparatus having a spinning rotor which forms therein air-discharge apertures, the opening in said spinning rotor being openably closed by a body member which has a fibers delivery aperture formed therein; said rotor sealing device being characterized in that a sealing member is inserted into the space located between said rotor opening and said body member positioned in opposite relation thereto. This device, though being of such a simple construction, is capable of improving the effect of rotor inside sealing over devices heretofore.

8 Claims, 8 Drawing Figures

DEVICE FOR SEALING SPINNING ROTOR IN AN OPEN-END SPINNING APPARATUS

BACKGROUND OF THE INVENTION

The present invention relates to an improved device for successfully sealing the inside space of the spinning rotor from the atmosphere in a conventional open-end spinning apparatus.

In an open-end spinning apparatus of a typical form, a bundle of fibers supplied by a feed roller 1 is separated into individual fibers by combing action of a combing roller 2, and such individual fibers are then carried by said combing roller 2 through a fibers delivery aperture 3 to the spinning rotor 4. The individual fibers thus separated and supplied to the rotor 4 are collected in the form of a ring onto the collecting surface 5 of said spinning rotor 4, from which a yarn is formed and then drawn off the rotor 4. In such an arrangement of the open-end spinning apparatus, its spinning rotor 4 has therein outwardly-extending air-discharge apertures 6 formed as shown in FIG. 1 through which a flow of air stream is produced by vacuum created within the rotor 4 under the influence of centrifugal force which is developed by high-speed rotation of rotor 4 and causes the inside air to be flown out by such suctioning vacuum, thereby the individual fibers separated can be carried forwardly into the spinning rotor 4 by being entrained on such a flow of air stream.

In an attempt to permit the vacuum thus created in the spinning rotor 4 by air discharging out through said apertures 6 to act only on the space in said fibers delivery aperture 3, it has been so arranged that the opening 7 formed in the rotor 4 is constructed in a labyrinth configuration or is provided with a suitable sealing member. U.S. Pat. No. 3,874,751 is an example of prior art which teaches the use of such a labyrinth configuration of the rotor's opening 7. However, a sealing device using such a labyrinth structure is complicated in construction and satisfactory sealing performance cannot be expected therefrom. In particular, a spinning apparatus which uses resiliently-yieldable member to support the bearing for its spinning rotor does pose a serious problem because deflecting motion of the rotor due to the use of such resiliently-yieldable member may cause the rotating rotor to be brought into contact with any one of the adjacent component parts comprising the labyrinth structure, thus damaging the spinning apparatus. To avoid such a danger, various methods using a sealing member such as shown in FIGS. 1 and 2 have been used extensively. These conventional sealing means merely comprise a sealing member 10, as shown in FIGS. 1 and 2, which is affixed on the body member 9 containing therein fibers delivery aperture 3, etc. and is set simply in contact with the front face 8' of another body member 8 surrounding and housing the rotor 4, furthermore said sealing member 10 usually being made of elastic form materials, thereby having various disadvantages, which are described below.

The front face 8' of body member 8 adjacent to the above-mentioned rotor opening 7 is so arranged as to press against the sealing member 10 which is attached to another face 9' of the body member 9, said face 9' being located in opposed relation to said front face 8' of the body member 8, whereby a space "a" (best shown in FIG. 2) is formed between the rotor opening 7 and the face 9' located opposite thereto. This space "a", providing a space large enough for accumulation of harmful amount of minute fibers, tends to trap into this space such fiber pieces which are difficult to be caught on the collecting surface 5 of rotor 4, because said space is hardly put under the direct influence of air being discharged through air discharge aperture 3 in body member 9 into the spinning rotor 4, and therefore, the result will be dwelling of such minute fiber pieces in said space "a". To make matters worse, because the sealing member 10 made of elastic form materials has rough outer surfaces, minute fiber pieces attached to such surfaces will be extremely difficult to be detached therefrom, which will result in further promotion of dwelling or accumulation of such pieces. In this way, the space "a" has a fear of becoming a dwelling section for minute fiber pieces, or so-called fly, and furthermore with an increase of fly trapped into this space "a" the deposit of fly will be then placed under the influence of vacuum effect, which will force such fly to be drawn out of the space and be deposited or collected on the collecting surface 5 of the rotor 4 for being formed into a yarn, thereby inducing yarn breakage trouble during spinning operation and inviting degraded yarn quality which are due to ingress of such fly into the yarn to be spinned.

SUMMARY OF THE INVENTION

The present invention intends to eliminate the aforesaid disadvantages of conventional sealing devices, generally, by arranging the above-mentioned space "a" as small as possible, and more specifically, by making a provision that a member which is supported by the body member 9, at least, by means of an elastic or resilient member may be inserted into the space "a" formed between the rotor opening 7 and said body member 9 located in opposed relation thereto, thus partly filling or stuffing the space with a portion of said sealing member.

DETAILED DESCRIPTION OF THE PREFERRED EMBODIMENTS

Figure 1:
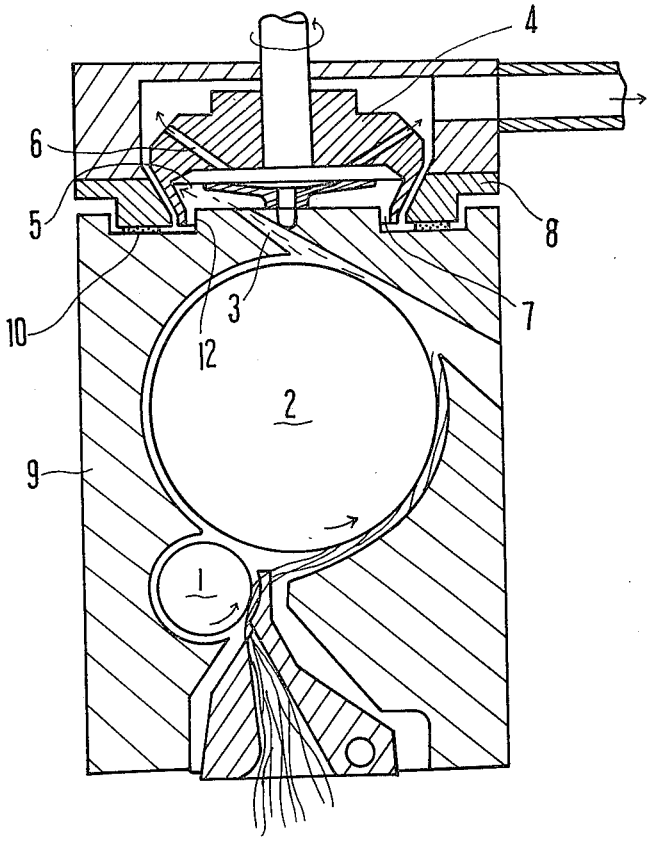
FIG. 1 PRIOR ART
FIG. 1 is a sectional plan view showing a general form of an open-end spinning apparatus, as well as a conventional rotor sealing device used on said apparatus.
Figure 2:
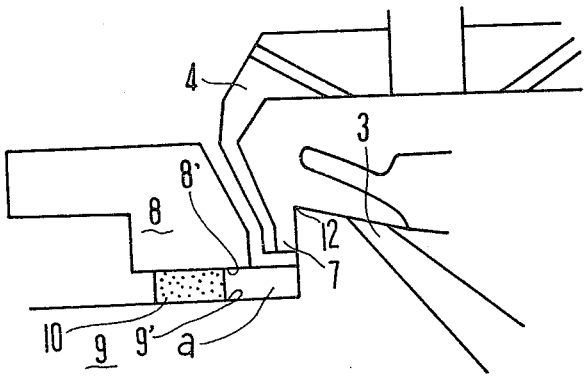
FIG. 2 PRIOR ART
FIG. 2 is a section view showing the details of the rotor sealing device of FIG. 1.
Figure 3A:
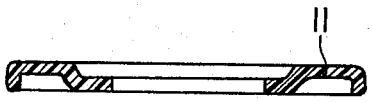
FIGS. 3(A) and 3(B) are sections illustrating an embodiment of the present invention.
Figure 3B:
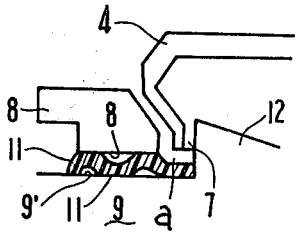

Referring now to the drawings, firstly to FIGS. 3(A) and 3(B), a rubber-made sealing member 10 is shown which is attached to the face 9' of body member 9 and is so arranged that it can extend not only outwardly over the entire front face 8' of body member 8 with which it is put in contact, but also inwardly all the way to the position of said face 9' facing the rotor opening 7. To describe this more concretely, a ring-shaped sealing member 11 is attached to the face 9' of body member 9 in such a way that the inner side of said sealing member 11 is set in snug contact with the outer peripheral side of the projection 12 which projects from the body member 9 towards the rotor 4. In so arranging, the space "a" which faces the rotor opening 7 can be stuffed with the inner side portion of the sealing member 11 to reduce the volume of the space formed there, thereby making it difficult for this space to serve as a dwelling section for minute fiber pieces or fly.

For the configuration of the sealing member 11, rectangular shape in section is avoided, instead, a form similar to an inverted channel or an inverted "U", as shown in FIG. 3(A), is employed, so that when said member 11 is compressed between the body members 8 and 9 it will firstly change its original form in such a way as to fill or stuff the hollow section, as shown in FIG. 3(B), and said member 11 then deformed elastically by further compression. As a result of such a manner of deformation of the sealing member 11, the amount of the elastic deformation can be very small but enough to accomplish successful airtight sealing effect, thus making it difficult for the interference between the sealing member 11 and spinning rotor 4, which usually results from excessive deformation of the elastic sealing member and also results in serious damage of the apparatus, to take place. In addition, the rubber-made sealing member 11 can provide smooth surfaces which serve to prevent fly from being attached to such surfaces.

Figure 4A:
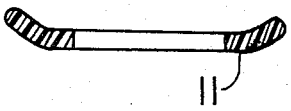
FIGS. 4(A) and 4(B) are sections illustrating another embodiment of the invention.
Figure 4B:
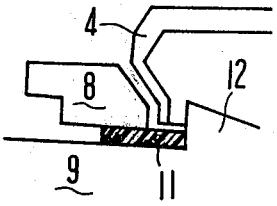

In the second preferred embodiment represented in FIGS. 4(A) and 4(B), a sealing member 11 in the form of a ring is used, the inner side of which is slipped over and in snug contact with the projection 12, while the outer side of which is turned away from the face 9' of body member 9, or turned toward the front face 8' of body member 8, thus forming a cupped-shape configuration as shown in FIG. 4(A). With use of such a sealing member 11, the inner side portion of said member 11 can be inserted into the space which faces the rotor opening 7 and, therefore, the volume of the space can be minimized as clearly seen in FIG. 4(B). Compression of this sealing member 11 by the front face 8' of body member 8 will cause said sealing member to change its original cupped shape into a flattened section with the outer side portion straightened, and further compression will then cause elastic deformation of the sealing member 11.

Figure 5A:
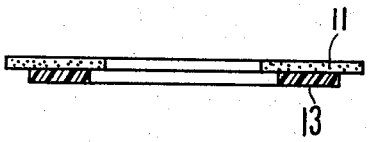
FIGS. 5(A) and 5(B) are sections illustrating still another embodiment of the invention.
Figure 5B:
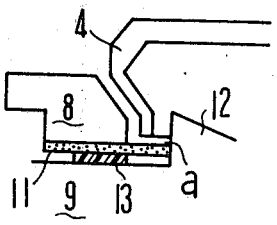

Though the use of a resilient or elastic material for the sealing member 11 is essential for accomplishing air-tight sealing performance, insertion of a member to fill or stuff the space "a" facing the rotor opening 7 does not necessarily call for the use of such material. In the above two preferred embodiments represented by FIGS. 3(A), 3(B) and FIGS. 4(A), 4(B), respectively, the resilient or elastic member itself used to serve as a sealing member 11 is inserted in such a way that it can extend as far as to the space "a"; while, FIGS. 5(A) and 5(B) show somewhat different arrangement according to the third embodiment of the invention, wherein a plate, e.g. a plastic plate in the form of a ring, also serving as a sealing member 11, is slipped and fitted over the projection 12 and is attached to the face 9' of body member 9 via an elastic or resilient member 13 interposed between said face 9' and said sealing member 11. In so arranging the sealing member 11 of plastic plate, it can be pressed tightly against the front face 8' of body member 8 by the resilient reaction exerted by the resilient member 13, thereby, to ensure satisfactory sealing effect, as well as to make the space "a" facing the rotor opening 7 as small as possible. Furthermore, the plastic sealing member 11 can provide smooth surfaces to prevent harmful accumulation or dwelling of fly in the space section. Still further, should the resilient member 13 by elastically deformed to a large extent in this embodiment, the resilient member 13, of course, and the sealing member 11, as well, are kept quite free from any contact with the spinning rotor 4.

The device according to the present invention as illustrated in the above embodiments, though being made of a simple structure wherein a portion of a sealing member supported by a body member which closes the rotor opening is simply inserted into the space formed between said rotor opening and said body member to reduce the volume of said space, is not only capable of improving the effect of rotor inside sealing over devices heretofore, but also, because the space can be thus reduced, it can prevent fly from dwelling in the space section which is located in opposite relation to said rotor opening and also placed where the influence of air discharging by rotation of the spinning rotor hardly acts. Therefore, disadvantages such as yarn breakage during spinning operation, degraded yarn quality, etc. which are due to "spinning" of fly can be prevented with a success.

What is claimed is:

1. A rotor sealing device used on an open-end spinning apparatus having a spinning rotor which forms therein air-discharge apertures, the opening in said spinning rotor being openably closed by a body member which has a fibers delivery aperture formed therein; said rotor sealing device being characterized in that a sealing member which is supported on said body member by means of an elastic or resilient material member is inserted into the space located between said rotor opening and said body member positioned in opposite relation thereto.

2. A rotor sealing device as set forth in claim 1, wherein said sealing member itself is the elastic or resilient material member.

3. A rotor sealing device as set forth in claim 1, wherein said sealing member is a ring-shaped plate which is supported by said body member by means of an elastic or resilient material member.

4. A rotor sealing device as set forth in claim 1, wherein said elastic or resilient material member is made of rubber.

5. A rotor sealing device as set forth in claim 1, wherein said sealing member is in the form of a ring the inner side of which is set in contact with the outer peripheral side of the projection extending from said body toward said spinning rotor.

6. A rotor sealing device as set forth in claim 2, wherein said sealing member is made of an elastic or resilient material member which has a shape similar to an inverted channel or an inverted "U".

7. A rotor sealing device as set forth in claim 2, wherein said sealing member is made of an elastic or resilient material member of a ring shape the inner side of which is set in contact with the outer peripheral side of the projection extending from said body member, while the outer side of which is turned away from the face of said body member.

8. A rotor sealing device as set forth in claim 3, wherein said sealing member is made of a plastic ring-shaped plate.

* * * * *